US009210976B2

(12) United States Patent
Maeda

(10) Patent No.: US 9,210,976 B2
(45) Date of Patent: Dec. 15, 2015

(54) APPARATUS FOR CARRYING PORTABLE ELECTRONIC DEVICES OF A WIDE RANGE OF SIZES

(75) Inventor: Nobuo Maeda, Kowloon (HK)

(73) Assignee: Samsonite IP Holdings S.a.r.l., Luxembourg (LU)

( * ) Notice: Subject to any disclaimer, the term of this patent is extended or adjusted under 35 U.S.C. 154(b) by 324 days.

(21) Appl. No.: 13/219,308

(22) Filed: Aug. 26, 2011

(65) Prior Publication Data

US 2012/0125956 A1 May 24, 2012

Related U.S. Application Data

(60) Provisional application No. 61/377,768, filed on Aug. 27, 2010.

(51) Int. Cl.

| | |
|---|---|
| ***B65D 81/02*** | (2006.01) |
| ***B65D 85/30*** | (2006.01) |
| ***A45C 11/00*** | (2006.01) |
| ***A45C 7/00*** | (2006.01) |

(52) U.S. Cl.

CPC ..... *A45C 11/00* (2013.01); *A45C 7/0054* (2013.01); *A45C 2011/003* (2013.01)

(58) Field of Classification Search

CPC ..... A45C 7/0054; A45C 11/00; A45C 2011/003; A45C 7/0095; A45C 13/02; A45C 3/02; A45C 2013/1015; A45C 2007/0004; B65D 81/02

USPC ..... 206/320, 305, 576, 583, 321, 478; 229/87.02–87.03; 190/103, 105, 107, 190/125, 1, 102, 111, 110

See application file for complete search history.

(56) References Cited

U.S. PATENT DOCUMENTS

| | | | | |
|---|---|---|---|---|
| 3,321,120 | A | 5/1967 | Cunningham | |
| 4,573,573 | A * | 3/1986 | Favaro | 206/305 |
| 4,941,603 | A | 7/1990 | Creamer et al. | |
| 5,209,384 | A | 5/1993 | Anderson | |
| 5,529,184 | A * | 6/1996 | Sadow | 206/320 |
| 5,988,476 | A | 11/1999 | Olerio | |
| 6,129,254 | A | 10/2000 | Yu | |
| 6,213,267 | B1 | 4/2001 | Miller | |
| 6,474,524 | B1 | 11/2002 | Ivarson et al. | |
| 6,491,074 | B1 | 12/2002 | Roegner | |
| 6,612,432 | B2 | 9/2003 | Motson | |
| 6,659,320 | B1 | 12/2003 | Alves et al. | |
| 7,036,642 | B2 * | 5/2006 | Hoberman et al. | 206/320 |

(Continued)

FOREIGN PATENT DOCUMENTS

| | | |
|---|---|---|
| CN | 2255178 Y | 6/1997 |
| WO | 0027728 A1 | 5/2000 |

*Primary Examiner* — Chun Cheung

(74) *Attorney, Agent, or Firm* — Dorsey & Whitney LLP

(57) ABSTRACT

An adjustable apparatus (e.g., a case or sleeve) for carrying a portable electronic device may include a back wall, a right wall, a left wall, and a front wall. The back wall may include right, left, bottom and top edges. The right, left and front walls may each include a free end and an attached end opposite the free end. The right wall's attached end may be joined to the back wall closer to the right edge than the left edge. The left wall's attached end may be joined to the back wall closer to the left edge than the right edge. The front wall's attached end may be joined to the back wall closer to the bottom edge than the top edge. The free ends of the right and left walls may be repeatably and adjustably coupled to the front wall via securing features, such as hook-and-loop fasteners.

34 Claims, 10 Drawing Sheets

(56) References Cited

U.S. PATENT DOCUMENTS

| | | | | |
|---|---|---|---|---|
| D531,409 | S * | 11/2006 | Tullmann et al. | D3/299 |
| 7,293,649 | B2 | 11/2007 | Gelphman et al. | |
| 7,487,896 | B2 | 2/2009 | Howard, Jr. et al. | |
| 7,540,378 | B2 * | 6/2009 | Gallagher | 206/320 |
| 2005/0236452 | A1 | 10/2005 | Rose et al. | |
| 2007/0246386 | A1 * | 10/2007 | Nykoluk et al. | 206/320 |
| 2008/0202958 | A1 * | 8/2008 | Hanlen et al. | 206/320 |
| 2009/0230006 | A1 * | 9/2009 | Pidgley et al. | 206/320 |
| 2010/0089778 | A1 * | 4/2010 | Park | 206/320 |
| 2010/0089779 | A1 | 4/2010 | Bowers | |

* cited by examiner

APPARATUS FOR CARRYING PORTABLE ELECTRONIC DEVICES OF A WIDE RANGE OF SIZES

CROSS-REFERENCE TO RELATED APPLICATIONS

This application claims the benefit, under 35 U.S.C. §119 (e), of U.S. provisional application No. 61/377,768, entitled "Protective Case Or Sleeve For Carrying Portable Electronic Computing Devices Of A Wide Range Of Sizes" and filed on Aug. 27, 2010, the entirety of which is hereby incorporated herein by reference.

TECHNOLOGICAL FIELD

Described herein are protective cases, sleeves or other containment systems for carrying a portable electronic device, such as, for example, a laptop computer.

BACKGROUND

Consumers are increasingly offered a variety of sizes when it comes to portable electronic devices such as, for example, laptop computers. For example, current standard sized laptop computers are often available with screen sizes ranging between 13 inches and 17 inches. Screen sizes for mini laptop computers may be in the range of 10" or smaller, and extra large laptop computers may have screen sizes that exceed 17 inches. Some laptop computers are thick while others are extremely thin, e.g., the MacBook Air™ or the iMac™ laptop computers.

It is common for a person to own more than one portable electronic device, choosing to carry one device over the other depending on the needs of the person. For example, a professional may elect to carry a very large laptop computer when visiting a client to give a presentation, while electing to carry an iMac™ laptop computer when not working.

Many portable electronic device carrying systems, such as bags or cases, are designed to securely receive a relatively small range of sizes for portable electronic devices. As such, an individual may undesirably need multiple bags or cases to transport in a secure manner each device owned by the person.

BRIEF SUMMARY

In one embodiment, a containment apparatus for receiving a portable electronic device may include a base, a first flap, a second flap, a third flap, and a securing element. The base may include a generally planar region, a first edge, a second edge opposite the first edge, a third edge extending between the first edge and second edge, and a fourth edge opposite the third edge. The generally planar region may be bordered by the first, second, third and fourth edges. The first, second, and third flaps and the securing element may extend from the base. The first flap may include a first inner surface, a first outer surface, and a first engagement feature. The second flap may include a second inner surface, a second outer surface, and a second engagement feature. The third flap may include a third inner surface, a third outer surface, and a third engagement feature. The securing element may be positioned on a portion of the base distal from the first flap. The securing element may include a fourth inner surface, a fourth outer surface, and a fourth engagement feature.

When the apparatus is in an open condition in preparation for receiving the device, the first inner surface, the second inner surface, the third inner surface, and the fourth inner surface can be caused to face in generally the same direction as faced by the generally planar region. When the apparatus is in a closed condition about the device, the first inner surface, the second inner surface, the third inner surface, and the fourth inner surface face generally towards the generally planar region with at least one of the second, third, or fourth engagement features engaging the first engagement feature. Further, the first flap, the second flap, the third flap, and the base may collectively define an enclosing volume sized to receive at least a portion of the device therein.

In another embodiment, a containment apparatus for receiving a portable electronic device may include a base wall, a first wall, a second wall, a third wall, and a securing element. The base wall may include a right edge, a left edge, a bottom edge and a top edge. The securing element and the first, second, and third walls may each include a free end and an attached end opposite the free end. The attached ends of the securing element and the first, second and third walls may each be joined to the base wall. The securing element may be positioned on the base wall on a portion of the base wall distal from the third wall. The free ends of the first wall, the second wall, and the securing element may be repeatably and adjustably coupled to the third wall.

Yet another embodiment may take the form of a method of enclosing a portable electronic device in a containment apparatus. The method may include placing the device on a surface of a back wall. The method may also include folding a front wall that is joined to the back wall over the device so the device is positioned between the back wall and the front wall. The method may further include folding a right wall that is joined to the back wall over the front wall and securing the right wall to the front wall via engagement between securing features of the right wall and the front wall. The method may yet further include folding a left wall that is joined to the back wall over the front wall and securing the left wall to the front wall via engagement between securing features of the left wall and the front wall. The method may also include folding a securing element that is coupled to the back wall over the front wall and securing the securing element to the front wall via engagement between securing features of the securing element and the front wall.

In yet another embodiment, a containment apparatus for receiving a portable electronic computing device may include a base, a first flap, a second flap, and a third flap. The base may include a generally planar region, a first edge, a second edge opposite the first edge, a third edge extending between the first edge and second edge, and a fourth edge opposite the third edge. The generally planar region may be bordered by the first, second, third and fourth edges. The first, second, and third flaps may extend from the base. The first flap may include a first inner surface, a first outer surface, and a first engagement feature. The second flap may include a second inner surface, a second outer surface, and a second engagement feature. The third flap may extend from the base. The third flap may include a third inner surface, a third outer surface, and a third engagement feature. At least one of the second flap or the third flap may include a plurality of rectangular regions with each rectangular region joined to an adjacent rectangular region via a joint such that each rectangular region may be selectively pivoted relative to an adjacent rectangular region.

When the apparatus is in an open condition in preparation for receiving the device, the first inner surface, the second inner surface, and the third inner surface can be caused to face in generally the same direction as faced by the generally planar region. When the apparatus is in a closed condition about the device, the first inner surface, the second inner surface, and the third inner surface face generally towards the generally planar region with at least one of the second or third engagement features engaging the first engagement feature. Further, the first flap, the second flap, the third flap, and the base may collectively define an enclosing volume sized to receive at least a portion of the device therein.

In still yet another embodiment, a containment apparatus for receiving a portable electronic device may include a base, a first flap, a second flap, and a third flap. The base may include a generally planar region, a first edge, a second edge opposite the first edge, a third edge extending between the first edge and second edge, and a fourth edge opposite the third edge. The generally planar region may be bordered by the first, second, third and fourth edges. The first, second and third flaps may extend from the base. The first flap may include a first inner surface, a first outer surface, and a first engagement feature. The second flap may include a second inner surface, a second outer surface, and a second engagement feature. The third flap may include a third inner surface, a third outer surface, and a third engagement feature. At least one of the second flap or the third flap may include a plurality of padded regions with each padded region joined to an adjacent padded region via a joint such that each rectangular region may be selectively pivoted relative to an adjacent rectangular region.

When the apparatus is in an open condition in preparation for receiving the device, the first inner surface, the second inner surface, and the third inner surface can be caused to face in generally the same direction as faced by the generally planar region. When the apparatus is in a closed condition about the device, the first inner surface, the second inner surface, and the third inner surface face generally towards the generally planar region with at least one of the second or third engagement features engaging the first engagement feature. Further, the first flap, the second flap, the third flap, and the base may collectively define an enclosing volume sized to receive at least a portion of the device therein.

DETAILED DESCRIPTION

Figure 1:
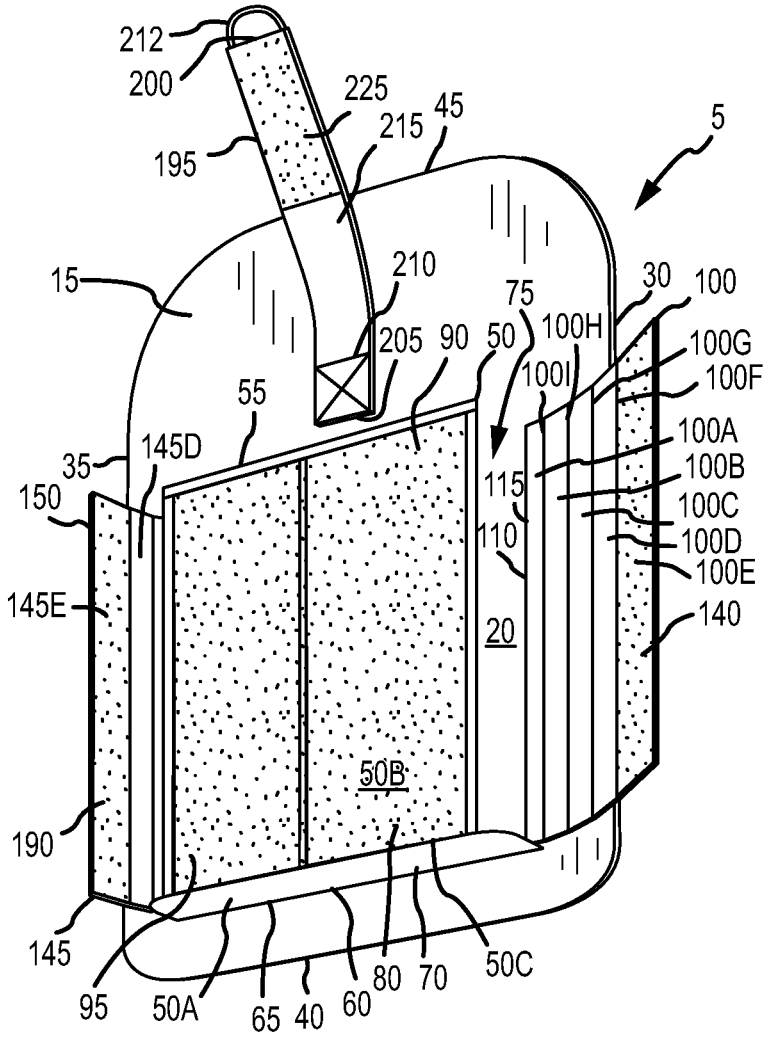
FIG. 1 is a front-bottom isometric view of a containment apparatus in a partially open state.

Described herein is a protective or supportive containment apparatus 5, such as a case, a sleeve or the like, configured to hold portable electronic devices 10 (e.g., laptop computers, electronic tablets, etc.) of a wide range of sizes. In some embodiments, the apparatus 5 may include a base 15, a first or bottom flap 50 extending from near a first or bottom edge 40 of the base, a securing element 195 extending from near a second or top edge 45 of the base, a second or right side flap 100 extending from near a third or right edge 30 of the base, and a third or left side flap 145 extending from near a fourth or left edge 35 of the base. The flaps may be configured to define walls of an enclosing volume 75 for receiving at least a portion of the device 10 therein, and the securing element may be configured to secure the device in the enclosing volume defined by the walls. In some embodiments, the base 15 may form the back wall, the bottom flap 50 and first portions of the right and left flaps may form the front wall, a second portion of the right flap 100 may form the right wall, and a second portion of the left flap 145 may form the left wall.

To create the enclosing volume, the bottom flap may be folded up and over the device 10 to be held by the apparatus 5. As viewed from the front of the apparatus, the right flap may be folded to the left and over the right side of the device and the outer face 90 of the bottom flap. A first securing feature 95 of the bottom flap may be engaged with a second securing feature 140 of the right flap. As viewed from the front of the apparatus, the left flap may be folded to the right and over the left side of the device and the outer face 90 of the bottom flap. A third securing feature 190 of the left flap may engage the first securing feature 95 of the bottom flap.

To secure the device 10 within the enclosing volume defined by the base and the bottom, right and left flaps, the securing element 195 may be folded down and over the top edge of the device 10 and the outer face 90 of the bottom flap. A fourth securing feature 225 of the securing element may engage the first securing feature 95 of the bottom flap 50.

Because the securing features' of the right flap, left flap and securing element are adjustably and repeatably securable to the securing feature of the bottom flap, the flaps and securing element can be secured snugly about a device of a first size and then secured snugly about another device of a second size that is substantially different than the first size. Thus, a single apparatus 5 can be employed to carry two or more differently sized devices owned by a user.

Figure 2:
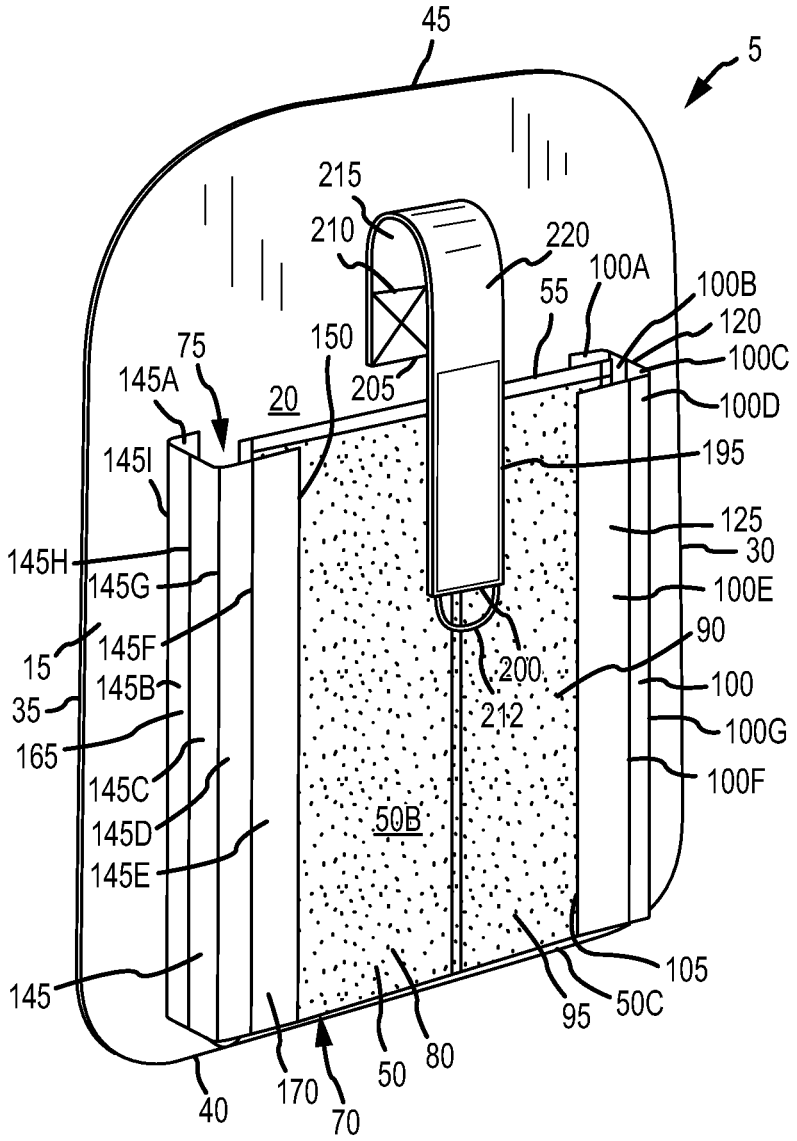
FIG. 2 is a front-top isometric view of the apparatus in a closed state.
Figure 3:
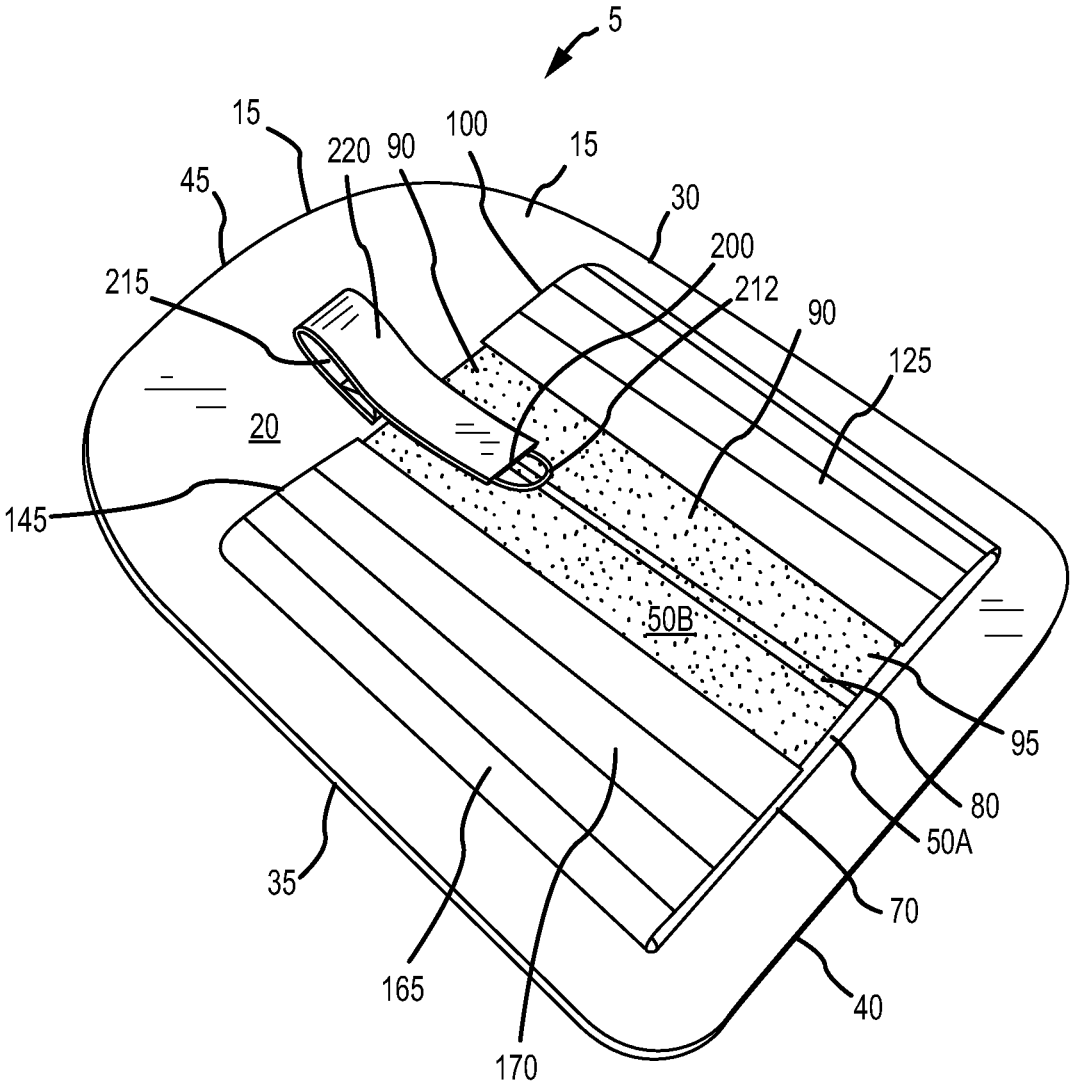
FIG. 3 is the same as FIG. 2, except being depicted in a front-bottom isometric view.

For a general discussion of an embodiment of a containment apparatus for carrying a range of sizes of portable electronic computing devices, reference is made to FIGS. 1-4. FIG. 1 is a front-bottom isometric view of the containment apparatus 5 in a partially open state. FIG. 2 is a front-top isometric view of the case 5 in a closed state. FIG. 3 is the same as FIG. 2, except being depicted in a front-bottom isometric view.

For convenience, the edges of the base may be generally be referenced in the detailed description as the bottom edge, the top edge, the right edge, and the left edge with the understanding that the "bottom edge" could also be referred to as the "first edge", the "top edge" as the "second edge", the "right edge" as the "third edge", and the "left edge" as the "fourth edge". Similarly, the flaps may generally be referenced in the detailed description as the bottom flap, the right flap, and the left flap with the understanding that the "bottom flap" could also be referred to as the "first flap", the "right flap" as the "second flap", and the "left flap" as the "third flap". Further, the terms "bottom", "top", "right", "left", "first", "second", "third", and "fourth" are used to facilitate the user's understanding of the apparatus and are not intended to imply that any particular edge must necessarily be the "bottom", "top", "right", "left", "first", "second", "third", or "fourth" edge; that any particular flap must necessarily be the "bottom", "right", "left", "first", "second", or "third" flap; and that any particular securing feature must necessarily be the "first", "second", "third", or "fourth" securing feature.

With reference to FIGS. 1-3, in one embodiment, the protective or supportive containment apparatus 5 may take the form of a case or the like. The apparatus 5 may include a base 15 with a generally planar front region 20 and a generally planar back region opposite the front region 20. Viewing the apparatus from the front, the base 15 may also include a first or bottom edge 40, a second or top edge 45 opposite the first or bottom edge 40, a third or right edge 30 between the top and bottom edges, and a fourth or left edge 35 opposite the right edge 30. In some embodiments, the edges 30, 35, 40, 45 can be said to be the transition between the front and back planar regions.

Figure 4:
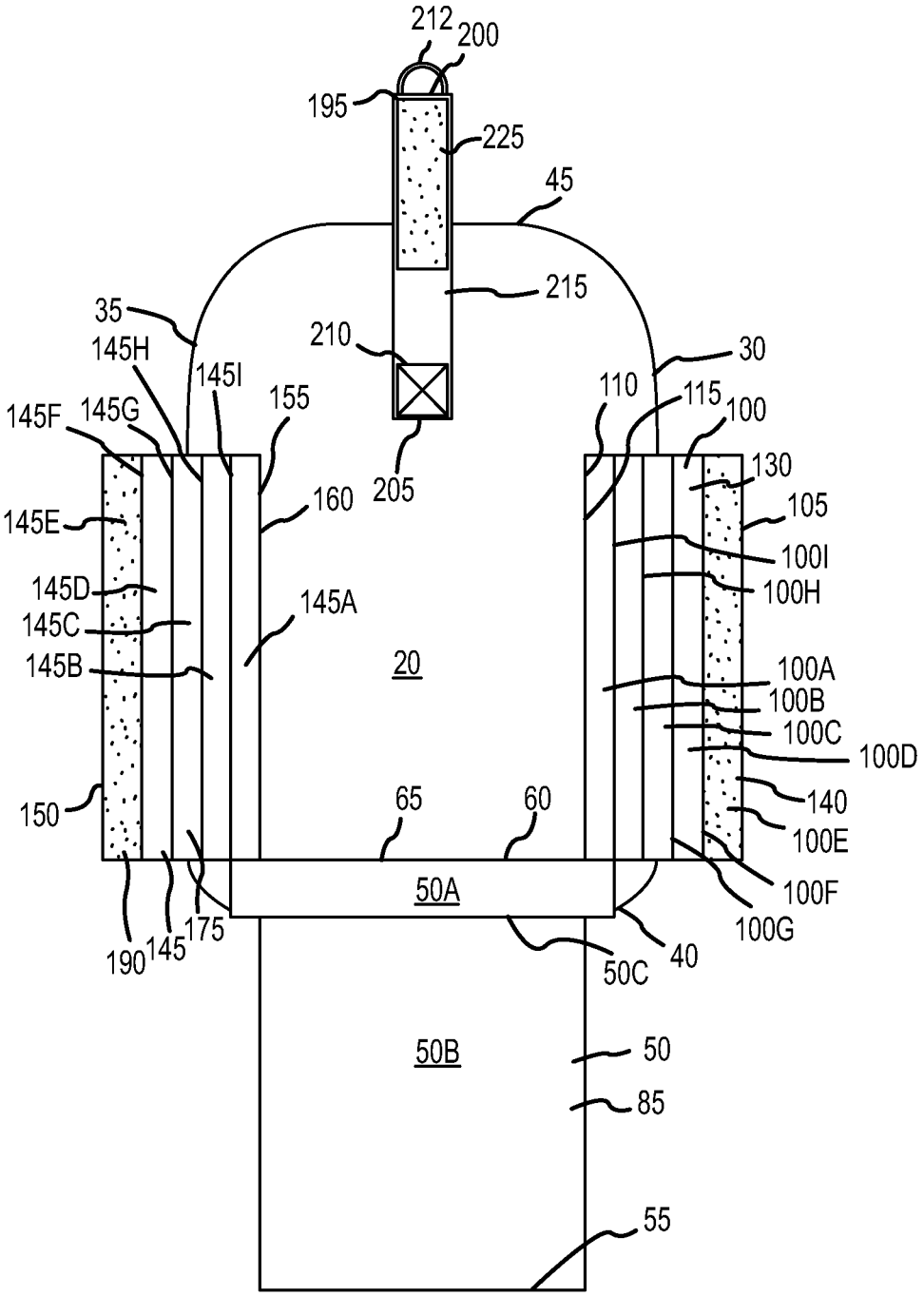
FIG. 4 is a plan view of the front of the apparatus in a fully open state.

Turning to FIGS. 1, 3 and 4, a first or bottom flap 50 may extend from the planar front region 20 of the base 15 from a region of the base 15 that is closer to the bottom edge 40 than the top edge 45. The bottom flap 50 may include a free end 55 and an attached end 60 opposite the free end 55. The attached end 60 may be joined to the planar front region 20 via a seam 65 or other suitable connection mechanism, such as, but not limited to, hook-and-loop fasteners, snap fasteners, adhesives, or living hinges, that allows the bottom flap 50 to be selectively pivoted relative to the base 15.

The seam 65 may generally define a first pivot axis that the bottom flap 50 may be selectively pivoted around. The seam 65 may further define a first elongated line that generally coincides with the first pivot axis. In some embodiments, the first pivot axis and the first elongated line may generally be parallel to the bottom edge 40.

With reference to FIG. 4, the bottom flap 50 may be formed of two bottom flap regions 50A, 50B joined together by a joint 50C, a bending fold, or any other structure that allows the flap regions 50A, 50B to be selectively pivoted relative to each other. The joint 50C may be formed via a folding line stitch, a living hinge, or any other structural mechanism that allows the bottom flap regions 50A, 50B to be pivoted relative to each other. The bottom flap regions 50A, 50B may be generally rectangular in shape or any other pre-selected shape so long as the other pre-selected shapes allow the bottom flap regions to function at least as portions of the bottom and front walls of the enclosing volume 75.

The joint 50C allows the two bottom flap regions 50A, 50B to pivot relative to each other to permit one bottom flap region to be positioned at one or more desired angles relative to the other bottom flap region. This selective pivotal movement between the first and second bottom flap regions 50A, 50B in conjunction with the ability to selectively pivot the first bottom flap region 50A relative to the base 15 along the seam 65 allows the bottom flap 50 to be selectively moved between an open configuration as shown in FIG. 4 and a closed configuration as shown in FIG. 3.

When the bottom flap 50 is located in its open position, the second bottom flap region 50B may generally be located within the same plane as the first bottom flap region 50A, and the angle formed between the first bottom flap region 50A and the base 15 may be generally close to 180 degrees. In this opened state, the base 15 is generally not covered or otherwise hidden by the bottom flap 50. When the bottom flap 50 is located in its closed position, the second bottom flap region 50B may be positioned to extend away from the first bottom flap region 50A at a generally right angle, and the first bottom flap 50A may be positioned to extend away from the base 15 at a generally right angle. As a result, when the apparatus 5 is in the closed state depicted in FIGS. 2 and 3, the first bottom flap region 50A forms a bottom enclosing wall 70 of the device enclosing volume 75, and the second bottom flap region 50B forms at least a portion of a front wall 80 of the device enclosing volume 75. In some embodiments, the width of the first bottom flap region 50A may exceed the width of second bottom flap region 50B.

Figure 5:
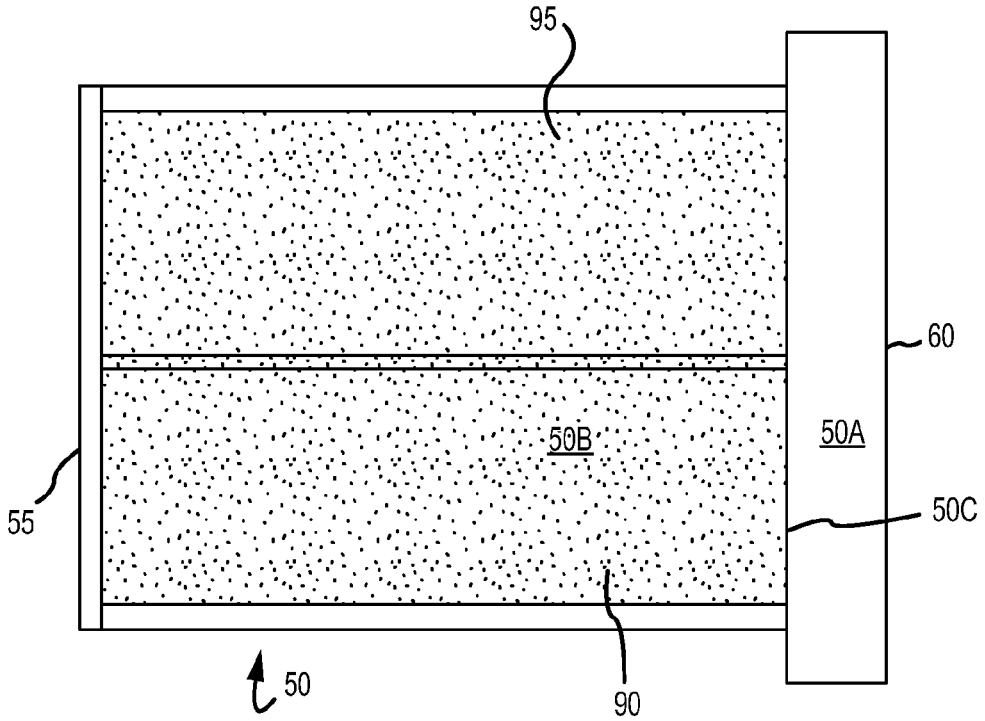
FIG. 5 is a plan view of the opposite side of the bottom flap depicted in FIG. 4.

Turning to FIG. 4 and FIG. 5, which is a plan view of the opposite side of the bottom flap 50 depicted in FIG. 4, the bottom flap 50 may include an inner face 85 (shown in FIG. 4) and an outer face 90 (shown in FIG. 5). As shown in FIG. 4, when the case 5 is in an open condition in preparation for receiving the device 10, the inner face 85 may face in generally the same direction as faced by the front region 20; and the outer face 90 may face in generally the same direction as faced by the back region. As shown in FIGS. 1-3, when the case 5 is in a closed condition about the device 10, the inner face 85 may face towards the front region 20, and the outer face 90 may face forward.

In some embodiments, the inner face 85 and the outer face 90 of the bottom flap regions 50A, 50B may be formed using a fabric material (e.g., nylon, polyester, etc.), a shock absorbing material (e.g., Neoprene® foam), or some combination thereof. In some embodiments that utilize fabric material, the fabric material may enclose a foam or other shock absorbing material or system, rigid or relatively rigid materials (e.g., a polypropylene or polyethylene sheet), or some combination of shock absorbing and rigid or relatively rigid materials. In other embodiments, the inner face 85 and the outer face 90 of the regions 50A, 50B may be formed using rigid or relatively rigid materials (e.g., plastics such as acrylonitrile butadiene styrene ("ABS"), polycarbonate, or ABS/polycarbonate). The shock absorbing, rigid, or relatively rigid materials may be used to protect the device 10 contained in the enclosing volume 75.

A first securing feature 95, such as, for example, a hook-and-loop (e.g., Velcro™) material, may be joined to fabric material forming the outer face 90 of the second bottom flap region 50B or may be used in place of the fabric material forming the outer face 90 of the second bottom flap region 50B. At least a portion, up to the entirety, of the outer face 90 of the second bottom flap region 50B may covered or formed with the first securing feature 95. When the apparatus 5 is in a closed condition about the device 10, the first securing feature 95 of the bottom flap 50 faces forward.

Referring to FIGS. 1, 2 and 4, a second or right flap 100 may extend from the planar front region 20 of the base 15 that is closer to the right edge 30 than the left edge 35 of the base 15. The right flap 100 may include a free end 105 and an attached end 110 opposite the free end 105. The attached end 110 may be join to the planar front region 20 via a second seam 115 or other suitable connection mechanism, such as, but not limited to, hook-and-loop fasteners, snap fasteners, adhesives, or living hinges, that allows the right flap 100 to be selectively pivoted relative to the base 15.

The second seam 115 may generally define a second pivot axis that the right flap 100 may be selectively pivoted around. The second seam 115 may further define a second elongated line that generally coincides with the second pivot axis. In some embodiments, the second pivot axis and the second elongated line may generally be parallel to the right edge 30.

The right flap 100 may be formed of multiple (e.g., five or more or less) right flap regions 100A-E joined together by a series of by a joints 100E-I, bending folds, or any other structures that allow each right flap region 100A-E to be selectively pivoted relative to an adjacent right flap region 100A-E. The right flap regions 100A-E may be generally rectangular in shape or any other pre-selected shape so long as the other pre-selected shapes allow each right flap region to be pivoted relative to an adjacent right flap region and to function at least as portions of the right and front walls of the enclosing volume 75. Each joint 100E-I may be formed via folding line stitches, living hinges, or any other structural mechanism that allows each right flap region 100A-E to be pivoted relative to adjacent right flap regions 100A-E.

The joints 100E-I allow the right flap regions 100A-E to fold relative to each other as needed such that a first group of regions (e.g., 100A-C) can be positioned at a desired angle (for example, a generally right angle) relative to a second group of regions (e.g., 100D-E). As a result, when the apparatus 5 is configured in the closed state depicted in FIGS. 2 and 3, the first group of right flap regions (e.g., 100A-C) between the seam 115 of the attached end 110 and the fold 100G may form a right wall 120 of the device enclosing volume 75, and the second group of right flap regions (e.g., 100D-E) may form a right portion 125 of front wall 80 of the enclosing volume 75. Which right flap regions 100A-E of the right flap 100 form the right side enclosing wall 120 versus a right portion 125 of the front wall 80 depends on the thickness of the device 10 positioned within the enclosing volume 75.

Figure 6:
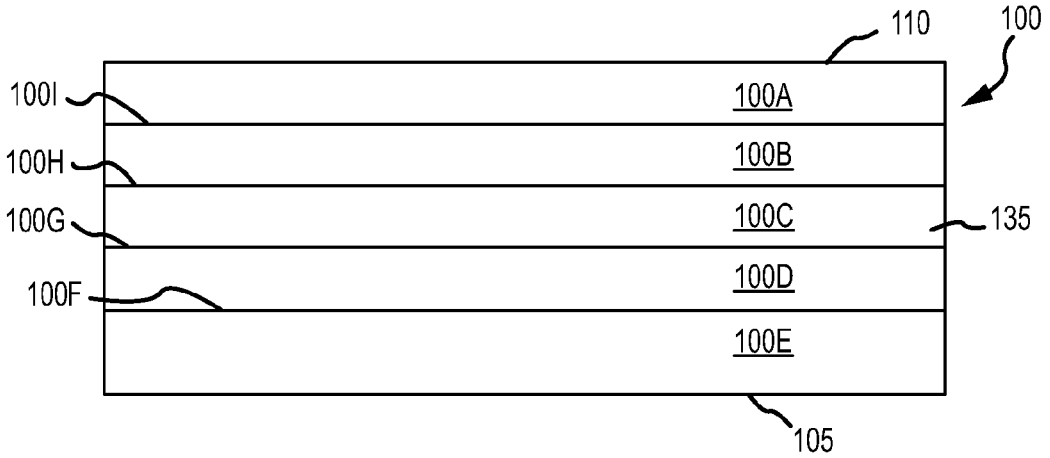
FIG. 6 is a plan view of the opposite side of the right side flap depicted in FIG. 4.

With reference to FIG. 4 and FIG. 6, which is a plan view of the opposite side of the right flap 100 depicted in FIG. 4, the right flap may include an inner face 130 (shown in FIG. 4) and an outer face 135 (shown in FIG. 6). When the apparatus 5 is in an open condition in preparation for receiving the device 10, the inner face 130 may face in generally the same direction as faced by the front region 20, and the outer face 135 may face in generally the same direction as faced by the back region. Referring to FIGS. 2-3, when the apparatus 5 is in a closed condition about the device 10, the inner face 130 may face towards the enclosing volume 75 and the front region 20, a first portion of the outer face 135 may face rightward, and a second portion of the outer face 135 may face forward. In this closed configuration, the first portion of the outer face 135 may define the right wall 120, and the second portion of the outer face 135 may define a right portion 125 of the front wall 80.

In some embodiments, the inner face 130 and the outer face 135 of the right flap regions 100A-E may be formed using a fabric material (e.g., nylon, polyester, etc.), a shock absorbing material (e.g., Neoprene® foam), or some combination thereof. In some embodiments that utilize fabric material, the fabric material may enclose a foam or other shock absorbing material or system, rigid or relatively rigid materials (e.g., a polypropylene or polyethylene sheet), or some combination of shock absorbing and rigid or relatively rigid materials. In yet other embodiments, the inner face 130 and the outer face 135 of the right flap regions 100A-E may be formed using rigid or relatively rigid materials (e.g., plastics such as ABS, polycarbonate, or ABS/polycarbonate). When the right flap regions 100A-E incorporate or otherwise utilize any shocking absorbing materials or systems, the right flap regions 100A-E may be considered to be padded or cushioned right flap regions 100A-E. The shock absorbing, rigid, or relatively rigid materials may be used to protect the device 10 contained in the enclosing volume 75.

A second securing feature 140, such as, for example, a hook-and-loop (e.g., Velcro™) material, may be joined to the fabric or other material forming the inner face 130 of at least one of the right flap regions 100A-E, or may be used in place of the fabric or other material forming the inner face 130 of at least one of the right flap regions 100A-E. At least a portion, up to the entirety, of any inner facing portion of the right flap regions 100A-E that include the second securing feature 140 may covered or formed with the second securing feature 140. For example, in one embodiment, nearly the entirety of the right flap region 100E nearest the free end 105 of the right flap 100 is covered with the second securing feature 140. When the apparatus 5 is in a closed condition, the second securing feature 140 of region 100E overlaps and engages the first securing feature 95 of the bottom flap 50.

Turning back to FIGS. 1, 2 and 4, a left flap 145 may extend from the planar front region 20 of the base 15 that is closer to the left edge 35 than the right edge 30. The left flap 145 may include a free end 150 and an attached end 155 opposite the free end 150. Similar to the right flap 100, the attached end 155 of the left flap 145 may be joined to the planar front region 20 via a third seam 160 or other suitable connection mechanism that allows the left flap 145 to be selectively pivoted relative to the base 15.

The third seam 160 may generally define a third pivot axis that the left flap 145 may be selectively pivoted around. The third seam 160 may further define a third elongated line that generally coincides with the third pivot axis. In some embodiments, the third pivot axis and the third elongated line may generally be parallel to the left edge 35. In some embodiments, the third pivot axis and the third elongated line may be positioned a pre-selected distance from, and generally parallel to, the second pivot axis and the second elongated line. The pre-selected distance may be set to be approximately equal to the minimum anticipated width for any portable electronic devices 10 that are intended to be positioned within the enclosing volume 75 of the apparatus 5. In some embodiments, the second pivot axis, the second elongated line, the third pivot axis, and the third elongated line may be generally transverse to the first pivot axis and the first elongated line.

Like the right flap 100, the left flap 145 may be formed of multiple (e.g., five or more or less) left flap regions 145A-E joined together by a series of by a joints 145F-I, bending folds, or any other structures that allow each left flap region 145A-E to be selectively pivoted relative to an adjacent left flap region 145A-E. The left flap regions 145A-E may be generally rectangular in shape or any other pre-selected shape so long as the other pre-selected shapes allow each right flap region to be pivoted relative to an adjacent right flap region and to function at least as portions of the right and front walls of the enclosing volume 75. Each joint 145F-I may be formed via folding line stitches, living hinges, or any other structural mechanism that allows each right flap region 145A-E to be pivoted relative to adjacent right flap regions 145A-E.

The joints 145F-I allow the left flap regions 145A-E to fold or pivot relative to each other as needed such that a first group of regions (e.g., 145A-C) may be positioned at a desired angle (for example, a generally right angle) relative to a second group of regions (e.g., 145D-E). As a result, when the apparatus 5 is in the closed state depicted in FIGS. 2 and 3, the first group of regions (e.g., 145A-C) between the seam 160 of the attached end 155 and the fold 145G forms a left enclosing wall 165 of the enclosing volume 75, and the second group of regions (e.g. 145D-E) forms a left portion 170 of the front wall 80 of the enclosing volume 75. Which left flap regions 145A-E of the left flap 145 form the left enclosing wall 165 versus the left portion 170 of the front wall 80 depends on the thickness of the device 10 held in the enclosing volume 75.

Figure 7:
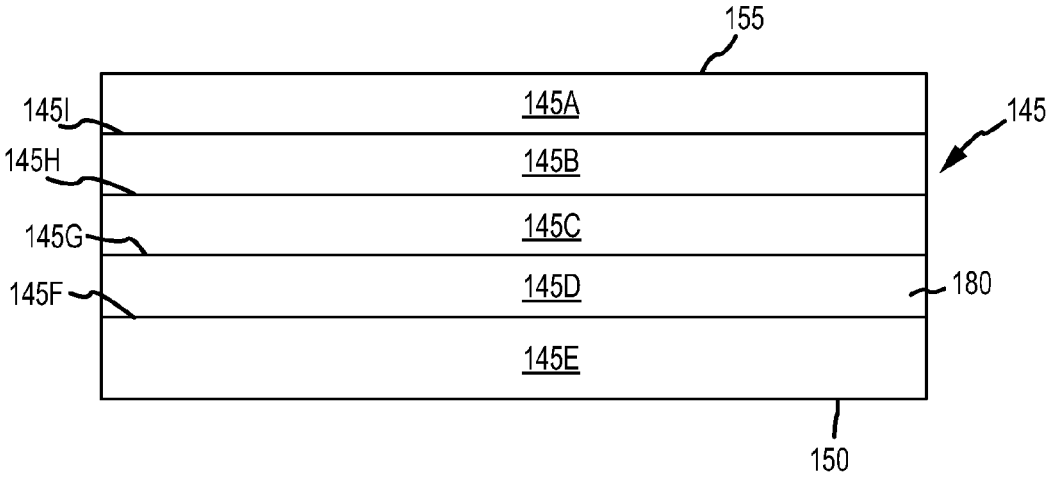
FIG. 7 is a plan view of the opposite side of the left side flap depicted in FIG. 4.
Figure 8:
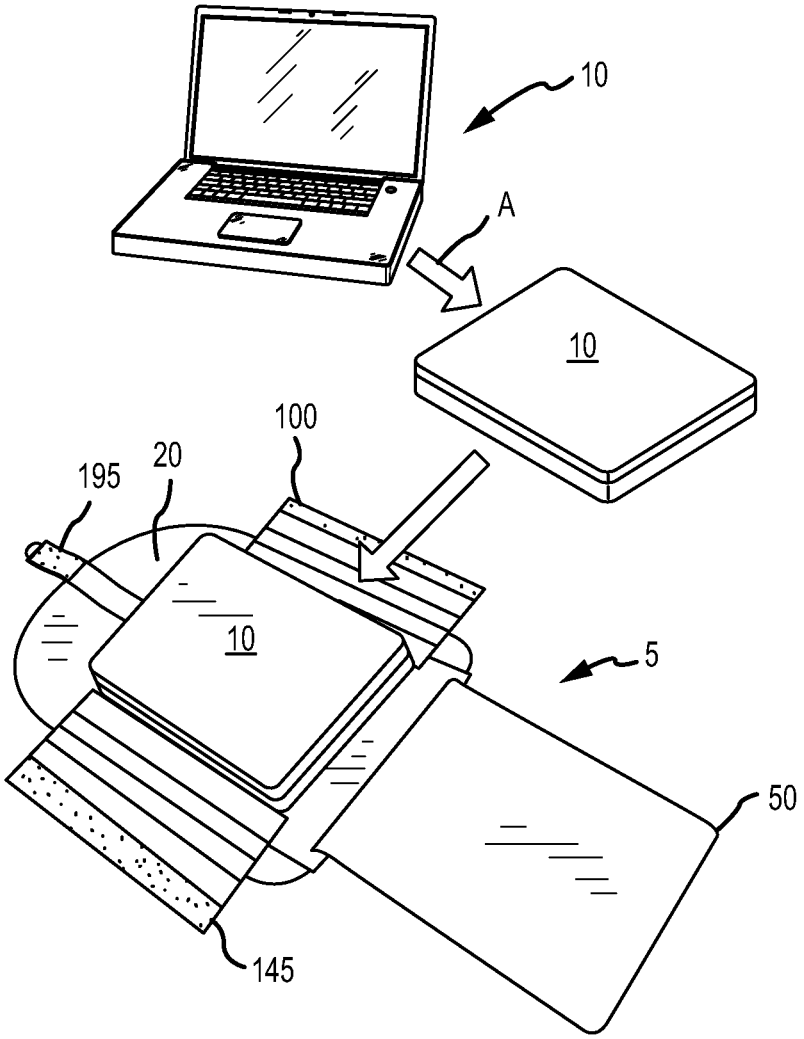
FIGS. 8-12 are isometric views of the apparatus and device during the various stages of the device being located within an enclosing volume defined by the apparatus.

Referring to FIG. 4 and FIG. 7, which is a plan view of the opposite side of the left side flap 145 depicted in FIG. 4, the left side flap may include an inner face 175 (shown in FIG. 4) and an outer face 180 (shown in FIG. 7). As shown in FIG. 4, when the apparatus 5 is in an open condition in preparation for receiving the device 10, the inner face 175 may face in generally the same direction as faced by the front region 20, and the outer face 180 may face in generally the same direction as faced by the back region. Turning to FIGS. 2 and 3, when the apparatus 5 is in a closed condition about the device 10, the inner face 175 may face towards the enclosing volume 75 and the front region 20, a first portion of the outer face 180 may face leftward, and a second portion of the outer face 180 may face forward. In this closed configuration, the first portion of the outer face 180 may define the left wall 165, and the second portion of the outer face 135 may define a left portion 170 of the front wall 80.

In some embodiments, the inner face 175 and the outer face 180 of the left flap regions 145A-E may be formed using a fabric material (e.g., nylon, polyester, etc.), a shock absorbing material (e.g., Neoprene® foam), or some combination thereof. In some embodiments that utilize fabric material, the fabric material may enclose foam or other shock absorbing material or system, rigid or relatively rigid materials (e.g., a polypropylene or polyethylene sheet), or some combination of shock absorbing and rigid or relatively rigid materials. In yet other embodiments, the inner face 175 and the outer face 180 of the left flap regions 145A-E may be formed using rigid or relatively rigid materials (e.g., plastics such as ABS, polycarbonate, ABS/polycarbonate). When the left flap regions 145A-E incorporate or otherwise utilize any shocking absorbing materials or systems, the left flap regions 145A-E may be considered to be padded or cushioned left flap regions 145A-E. The shock absorbing, rigid, or relatively rigid materials may be used to protect the device 10 contained in the enclosing volume 75.

A third securing feature 190, such as, for example, a hook-and-loop (e.g., Velcro™) material, may be joined to fabric or other material forming the inner face 175 of at least one of the left flap regions 145A-E, or may be used in place of the fabric or other material forming the inner face 175 of at least one of the right flap regions 145A-E. At least a portion, up to the entirety, of any inner facing portion of the left flap regions 145A-E that include the third securing feature 190 may covered or formed with the third securing feature 190. For example, in one embodiment, nearly the entirety of the left flap region 145E nearest the free end 150 of the left flap 145 is covered with the third securing feature 190. When the apparatus 5 is in a closed condition, the third securing feature 190 overlaps and engages the first securing feature 95 of the bottom flap 50.

When the three flaps 50, 100, 145 are positioned in the closed configuration, the inner surface of these three flaps 50, 100,145 may collectively define the enclosing volume 75. In some embodiments, the enclosing volume 75 may be sized so that a portion of the device 10 extends out of the enclosing volume 75. In such embodiments, this portion of the device 10 may be visible to the user while the remaining portion of the device 10 may be contained within the enclosing volume 75. The portion of the device 10 visible to the user may expose surfaces of the device 10 for the user to grasp to remove the device 10 from the enclosing volume 75 without positioning the flaps 50, 100, 145 in their open configuration. When a portion of the device 10 extends out of the enclosing volume 75, the portion extending out of the enclosing volume 75 may be less than the portion of the device 10 received within the enclosing volume 75. Further, in some embodiments, a substantial portion of the device 10 (e.g., approximately eighty percent or more) may be received in the enclosing volume 75. In yet other embodiments, the enclosing volume 75 may be sized so that the device 10 may be fully received within the enclosing volume 75. That is, the enclosing volume 75 may be sized such that no portion of the device 10 extends out of the enclosing volume 75.

Returning to FIGS. 1-4, a securing element 195, such as strap or other flexible element, may extend from the planar front region 20 of the base 15 that is closer to the top edge 45 than the bottom edge 40. The securing element 195 may include a free end 200 and an attached end 205 opposite the free end 200. The attached end may be attached to the planar front region 20 via a seam 210 or other suitable connection mechanism that allows the securing element 195 to be selectively pivoted relative to the base 15.

The free end may include a closed loop element 212, such as a circular or other shaped ring, that extends outwardly from the free end. The closed loop element 212 may provide an object for a user to grasp to facilitate separating the securing element 195 from the bottom flap 50.

The securing element 195 may be sufficiently flexible to allow the securing element 195 to bend as needed to secure the securing element 195 to the bottom flap 50 when the apparatus 5 is in the closed state depicted in FIGS. 2 and 3. When the securing element 195 is joined to the bottom flap 50, the distance between the joint 50C of the bottom flap 50 and the free end 200 of the securing element 195 depends on the thickness and length of the device 10 held in the enclosing volume 75.

The securing element 195 may include an inner face 215 (shown in FIGS. 1 and 4) and an outer face 220 (shown in FIGS. 2 and 3). When the apparatus 5 is in an open condition in preparation for receiving the device 10 (FIG. 4), the inner face 215 may face in generally the same direction as faced by the front region 20, and the outer face 220 may face in generally the same direction as faced by the back region. When the apparatus 5 is in a closed condition about the device 10 (FIGS. 2 and 3), a first portion of the inner face 215 may face towards the enclosing volume 75, a second portion of the inner face 215 may face towards the front region 20, a first portion of the outer face 220 may face towards the base 15, and a second portion of the outer face 220 may face forward.

The outer face 220 of the securing element 195 may simply be the surface of the material from which the securing element 195 is made (e.g., nylon, polyester, rubber, etc.). In some embodiments, a portion of the inner face 215 of the securing element 195 nearest the free end 200 may be a covered with a fourth securing feature 225, such as, for example, a hook-and-loop (e.g., Velcro™) material. When the apparatus 5 is in a closed condition about the device 10, the fourth securing feature 225 of the inner face 215 overlap and engage the first securing feature 95 of the bottom flap 50.

In one embodiment, the first securing feature 95 may be a female portion of a hook-and-loop material, and the second, third and fourth securing features 140, 190, 225 may each be a corresponding male portion. In other embodiments, the locations of the male and female hook-and-loop material portions may be reversed. In some embodiments, the securing features 95, 140, 190, 225 may be arrays of snaps or buttons. In yet other embodiments, the securing features may be arrangements of buckles, laces, or other fastening arrangements.

For a discussion of a method of employing the apparatus 5 to enclose or carry a portable electronic device 10, such as, for example, a laptop computer, reference is made to FIGS. 8-12, which are isometric views of the apparatus 5 and device 10 during the various stages of the device being secured to the apparatus. Starting with FIG. 8, the device 10 may be prepared for securement into the apparatus 5. For example, as shown at arrow A, the device may be transitioned from an open monitor configuration to a closed configuration. The device 10 may then be placed on the planar front region 20 and generally centered with respect to the attached ends of the flaps 50, 100, 145 and securing element 195 with the flaps and the securing element being in an open/expanded state.

Figure 9:
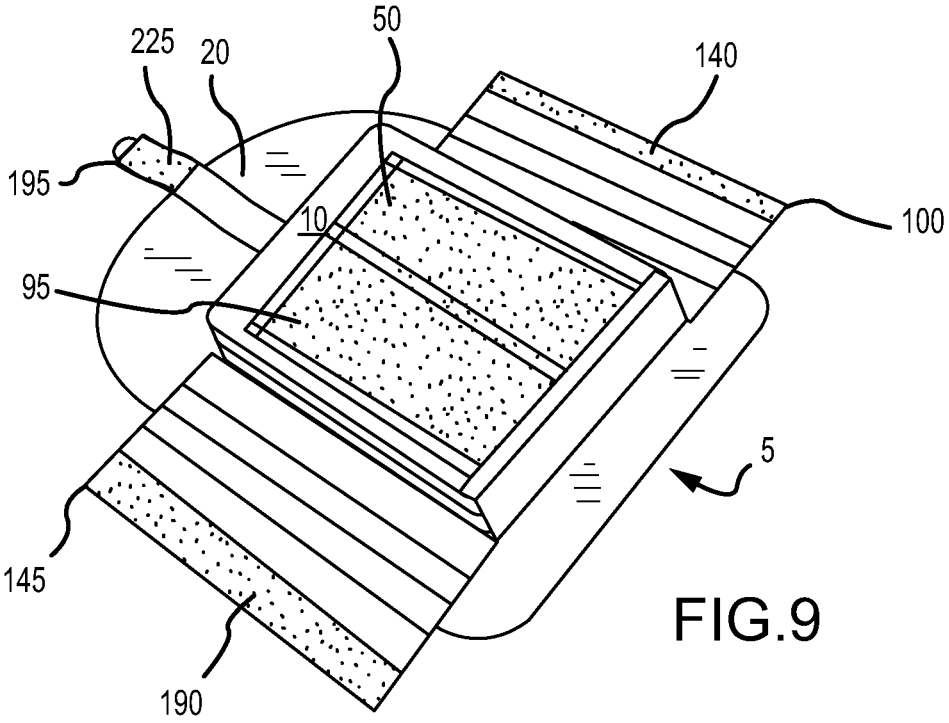

Turning to FIG. 9, the bottom flap 50 may be folded up and over the device 10 such that the device is positioned between the front region 20 and the bottom flap 50. The securing volume 75 has now begun to be defined by the front region and the inner surface of the bottom flap 50. The first securing feature 95 is now positioned for the second, third, and fourth securing features 140, 190, 225 to be secured thereto.

Figure 10:
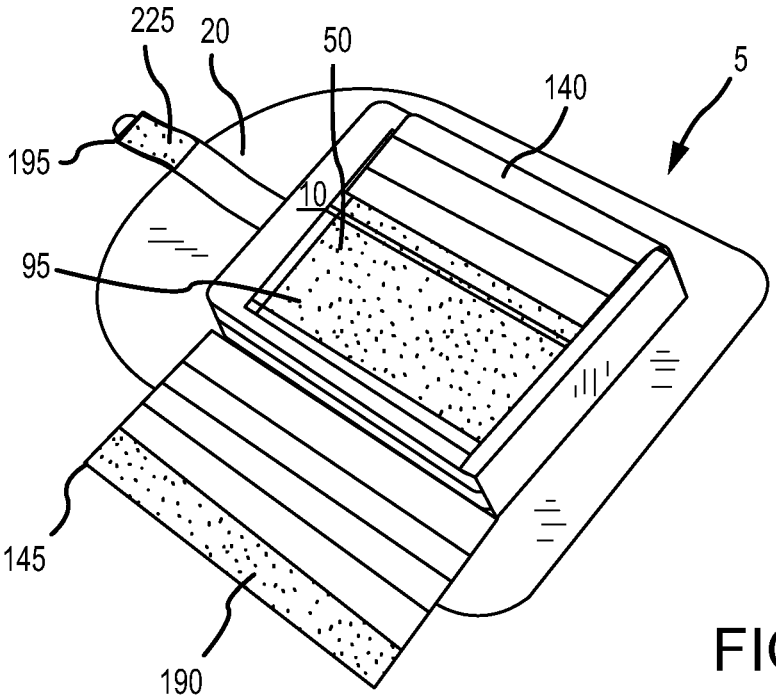

Referring to FIG. 10, one of the side flaps, for example, the right flap 100 may be folded up and over the device 10 and the bottom flap 50. The second securing feature 140 of the right flap 100 may be engaged with the first securing feature 95 of the bottom flap 50 to join the right flap 100 to the bottom flap 50. Thus, the enclosing volume 75 has been further defined by the inner surface of the right flap.

Figure 11:
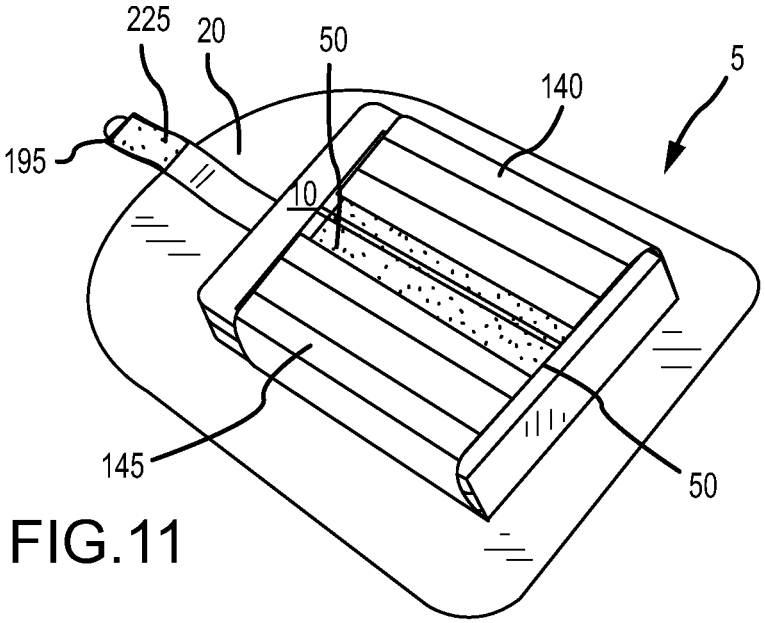

Now referring to FIG. 11, the other of the side flaps, for example, the left flap 145 may be folded up and over the device 10 and the bottom flap 50. The third securing feature 190 of the left flap 145 may be engaged with the first securing feature 95 of the bottom flap 50 to join the left flap 145 to the bottom flap 50. Thus, the enclosing volume 75 has been further defined by the inner surface of the left flap, the enclosing volume 75 being collectively defined by the inner surfaces of the three flaps 50, 100, 145.

Figure 12:
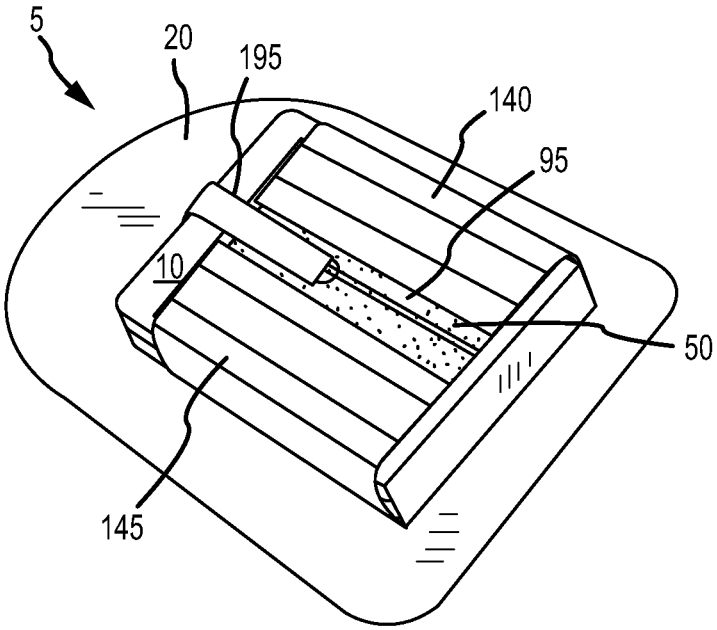

With reference to FIG. 12, the securing element 195 is folded over the device 10 and the bottom flap 50. The fourth securing feature 225 of the securing element 195 may be engaged with the first securing feature 95 of the bottom flap 50 to join the securing element 195 to the bottom flap 50. Thus, the device 10 is prevented from exiting the open top of the enclosing volume 75 by the presence of the securing element 195 positioned over device and joined to the bottom flap 50.

As can be understood from the preceding discussion, an apparatus for carrying a portable electronic device is described herein. The apparatus may include a back wall or a base. The apparatus may further include a front wall, a right wall, a left wall, or first, second, and third flaps, and a securing element attached to the back wall or base via respective seams that allow the securing element and front, right and left walls, or the first, second and third flaps, to be folded (e.g., in a hinge-like manner) over the back wall or base. Thus, when a device is placed on the back wall or base, the front wall or first flap may be folded up and over the device to sandwich the device between the back and front walls, or the base and the first flap. The right and left walls, or second and third flaps, may then be folded over the front wall, or first flap, and secured thereto in an adjustable and repeatable manner via a securing feature, such as, for example, Velcro™, that is on each of the walls, or flaps. The device is now enclosed within the enclosure volume defined by the back wall, right wall, left wall and front wall, or by the base, the first flap, the second flap and the third flap.

The securing element may then be folded over the front wall or the first flap and secured to the front wall or the first flap in an adjustable and repeatable manner via a securing feature, such as, for example, Velcro™. Thus, the size of the enclosure volume defined by the walls or the flaps may be custom fit for the size of the device by securing the walls or flaps to each other via securing features so that the walls or flaps snugly envelope the device. As a result, a user with devices 10 of multiple sizes and configurations can use a single apparatus 5 to meet the user's transportation needs for the devices.

Figure 13:
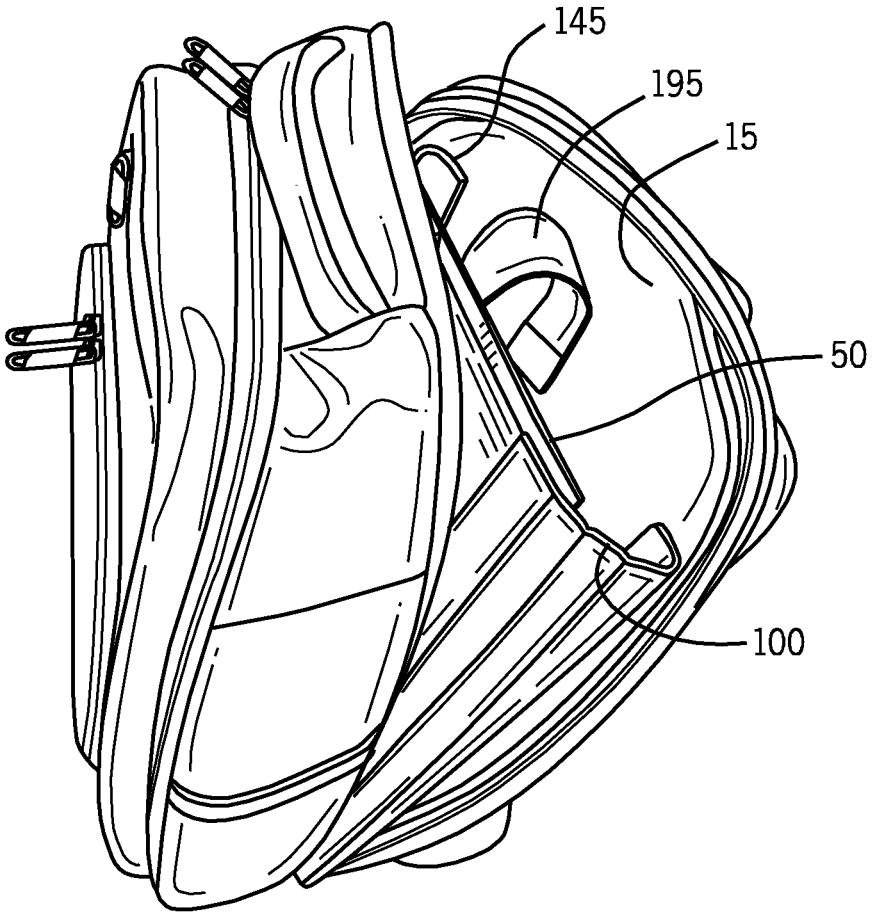
FIG. 13 is a perspective view of the apparatus depicted in a backpack.

The apparatus (e.g., a case or a sleeve) may be used to transport the device about in a protected manner or as a sleeve that is removably held in an outer case (e.g., brief case, backpack, etc.) for transporting the device. In some embodiments, the apparatus may be integrally incorporated into a case, a luggage piece, or the like (e.g., a brief case, a backpack, a suitcase, and so on). In such embodiments, the back wall or base may be a panel or other surface of the case, luggage piece or the like, and the front, right and left flaps or walls may be joined to the panel, see e.g., FIG. 13, which illustrates the apparatus in a backpack.

Although the protective or supportive containment apparatus is described herein with reference to illustrated embodiments, persons skilled in the art will recognize that changes may be made in form and detail without departing from the spirit and scope of the apparatus. Accordingly, the specific embodiments described herein should be understood as examples and not limiting the scope of the apparatus described and shown herein.

All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present disclosure, and do not create limitations, particularly as to the position, orientation, or use of the embodiments unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other.

In some instances, components are described with reference to "ends" having a particular characteristic and/or being connected with another part. However, those skilled in the art will recognize that the present disclosure is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present disclosure. It is intended that all matter contained in the above description or shown in the accompanying drawings shall be interpreted as illustrative only and not limiting. Changes in detail or structure may be made without departing from the spirit of the apparatus and method for using the apparatus described herein.

What is claimed is:

1. A bag with a main compartment and a separate portable electronic device compartment with an adjustable containment apparatus for receiving a portable electronic device, the apparatus comprising:

a base formed from a first piece of material and constituting a portion of a panel of the portable electronic device compartment of the bag, the base comprising a generally planar region, a first edge, a second edge opposite the first edge, a third edge extending between the first edge and second edge, and a fourth edge opposite the third edge, the generally planar region bordered by the first, second, third and fourth edges;

a first flap formed from a second piece of material, the first flap sewn to the base to extend therefrom and comprising a first inner surface and a first outer surface, the first flap including a first engagement feature;

a second flap formed from a third piece of material, the second flap sewn to the base to extend therefrom and comprising a second inner surface and a second outer surface, the second flap including a second engagement feature;

a third flap formed from a fourth piece of material, the third flap sewn to the base to extend therefrom and comprising a third inner surface and a third outer surface, the third flap including a third engagement feature; and a securing element positioned on and extending from a first face of the base and positioned on a portion of the base distal from the first flap, the securing element comprising a fourth inner surface and a fourth outer surface, and the securing element including a fourth engagement feature; wherein:

at least three of the first, second, third, and fourth edges of the base are distal to the sewing positions of at least three of the first flap, second flap, third flap, and securing element; and the second flap and the third flap each include a plurality of rectangular regions with each rectangular region joined to an adjacent rectangular region via a fold joint such that each rectangular region selectively pivots relative to an adjacent rectangular region at a fold joint; and when the apparatus is in an open condition in preparation for receiving the device, the first inner surface, the second inner surface, the third inner surface, and the fourth inner surface can be caused to face in generally the same direction as faced by the generally planar region; and when the apparatus is in a closed condition about the device, the first inner surface, the second inner surface, the third inner surface, and the fourth inner surface face generally towards the generally planar region with at least one of the second, third, or fourth engagement features engaging the first engagement feature, and the first flap, the second flap, the third flap, and the base collectively define an enclosing volume sized to receive at least a portion of the device therein.

2. The apparatus of claim 1, wherein the first engagement feature includes at least a portion of a hook-and-loop arrangement.

3. The apparatus of claim 2, where the at least a portion of the hook and loop arrangement is positioned on the first outer surface of the first flap.

4. The apparatus of claim 3, wherein the at least a portion of the hook-and-loop arrangement extends over a substantial portion of the first outer surface.

5. The apparatus of claim 1, wherein the securing element comprises an elongated strap.

6. The apparatus of claim 1, wherein the securing element includes an attached end sewn to the base, a free end distal the attached end, and a ring joined to the securing element proximate the free end.

7. The apparatus of claim 1, wherein the first flap is sewn to a portion of the base that is closer to the first edge than the second edge, the second flap is sewn to a portion of the base that is closer to the third edge than the fourth edge, and the third flap is sewn to a portion of the base that is closer to the fourth edge than the third edge.

8. The apparatus of claim 1, wherein the base further comprises a second face opposite the first face and the first flap, second flap, and the third flap extend from and are attached directly to the first face.

9. The apparatus of claim 1, wherein the first flap, second flap, third flap and securing element are positioned on and individually attached directly to the first face of the base.

10. The apparatus of claim 9, wherein the first engagement feature has a larger width than the second and third engagement features.

11. The apparatus of claim 1, wherein the plurality of rectangular regions extends along an entire length of at least one of the second flap and the third flap.

12. The apparatus of claim 1, wherein the first flap comprises a bottom flap region connected to the base at a base joint and a top flat region connected at a flap joint to the bottom flap, wherein the first engagement feature is formed on the top flap region.

13. The apparatus of claim 12, wherein in the closed position, the bottom flap region is oriented at a substantially right angle relative to the base and the top flap region is oriented at a substantially right angle relative to the bottom flap region.

14. The apparatus of claim 13, wherein the bottom flap region and the top flap region are substantially rigid such that the bottom flap region can be angled relative to the base only at the base joint and the top flap region can be angled relative to the bottom flap region only at the flap joint.

15. The apparatus of claim 1, wherein the first flap comprises a bottom flap region and a top flat region, wherein the bottom flap region defines a fixed dimension of the enclosing volume defined by a distance between the base and a top edge of the bottom flap.

16. The apparatus of claim 1, wherein each rectangular region of the second flap and the third flap pivots to multiple angles relative to an adjacent rectangular region at the fold joint.

17. A bag with a main compartment and a separate portable electronic device compartment with an adjustable containment apparatus for receiving a portable electronic device, the apparatus comprising:

a base wall formed from a first piece of material and constituting a portion of a panel of the electronic device compartment of the bag, the base wall including a right edge, a left edge, a bottom edge and a top edge;

a first wall including a free end and an attached end opposite the free end, the attached end of the first wall sewn to the base wall;

a second wall including a free end and an attached end opposite the free end, the attached end of the second wall sewn to the base wall;

a third wall including a free end defining a top flap and an attached end opposite the free end defining a bottom flap, the bottom flap being attached to the base wall;

a securing element including a free end and an attached end opposite the free end, the attached end of the securing element sewn to the base wall and positioned on and extending from a first face of the base wall on a portion of the base wall distal from the third wall; and the free ends of the first wall, the second wall, and the securing element are repeatably and adjustably coupled to the third wall, wherein the first wall and the second wall each include a plurality of rectangular regions with each rectangular region joined to an adjacent rectangular region via a fold joint such that each rectangular region selectively pivots to multiple angles relative to an adjacent rectangular region at a fold joint; and at least three of the right, left, bottom, and top edges of the base are distal to the sewing positions of at least three of the first wall, second wall, third wall, and securing element; and the third wall is sufficiently rigid such that the third wall bends only at a first joint between the top flap and the bottom flap and at a second joint between the bottom flap and the base wall.

18. The apparatus of claim 17, wherein the top flap is folded up and over the device when the device is positioned on a surface of the base wall.

19. The apparatus of claim 18, wherein at least one of the first wall or the second wall comprises a second flap that is folded up and over the third wall when the device is positioned between the surface of the base wall and a surface of the third wall.

20. The apparatus of claim 17, wherein the free ends of the first and second walls are repeatably and adjustably coupled to the third wall at least partially because of a hook-and-loop fastening system positioned on the first, second, and third walls.

21. The apparatus of claim 17, wherein the securing element comprises an elongated strap.

22. The apparatus of claim 17, further comprising a ring joined to the securing element proximate the free end of the securing element.

23. The apparatus of claim 17, wherein the first wall is sewn to a portion of the base wall that is closer to the right edge than the left edge, the second wall is sewn to a portion of the base wall that is closer to the left edge than the right edge, and the third wall is sewn to a portion of the base wall that is closer to the bottom edge than the top edge.

24. A method of enclosing a portable electronic device in a bag with a main compartment and a separate portable electronic device compartment with an adjustable containment apparatus, the method comprising:

placing the device on a surface of a back wall, the back wall formed from a first piece of material and constituting a portion of a panel of the portable electronic device compartment of the bag;

folding a front wall that is sewn to the back wall over the device so the device is positioned between the back wall and the front wall, wherein the front wall is formed from a second piece of material;

folding a right wall that is sewn to the back wall over the front wall and securing the right wall to the front wall via engagement between securing features of the right wall and the front wall, wherein the right wall is formed from a third piece of material and includes a plurality of rectangular regions with each rectangular region joined to an adjacent rectangular region via a fold joint such that each rectangular region selectively pivots relative to an adjacent rectangular region at a fold joint;

folding a left wall that is sewn to the back wall over the front wall and securing the left wall to the front wall via engagement between securing features of the left wall and the front wall, wherein the left wall is formed from a fourth piece of material and includes a plurality of rectangular regions with each rectangular region joined to an adjacent rectangular region via a fold joint such that each rectangular region selectively pivots relative to an adjacent rectangular region at a fold joint; and folding a securing element that is sewn to and extends from a front face of the back wall over the front wall and securing the securing element to the front wall via engagement between securing features of the securing element and the front wall; wherein the back wall comprises right, left, bottom, and top edges; and at least three of the edges of the back wall are distal to the sewing positions of at least three of the front wall, right wall, left wall and the securing element; and the left wall and the right wall include the plurality of rectangular regions with each rectangular region jointed to the adjacent rectangular region via the fold joint such that each rectangular region selectively pivots relative to an adjacent rectangular region at a fold joint.

25. The method of claim 24, wherein the engagement between securing features of the securing element and the front wall is at least partially due to a hook-and-loop feature positioned on the securing element and the front wall.

26. The method of claim 24, wherein the engagement between securing features of the front wall and at least one of the right wall or left wall is at least partially due to a hook-and-loop feature positioned on the front wall and at least one of the right wall or left wall.

27. A bag with a main compartment and a separate portable electronic device compartment with an adjustable containment apparatus for receiving a portable electronic computing device, the apparatus comprising:

a base formed from a first piece of material and constituting a portion of a panel of the portable electronic device compartment of the bag, the base comprising a generally planar region, a first edge, a second edge opposite the first edge, a third edge extending between the first edge and second edge, and a fourth edge opposite the third edge, the generally planar region bordered by the first, second, third and fourth edges;

a first flap formed from a second piece of material, the first flap sewn to the base to extend therefrom and comprising a first inner surface and a first outer surface, the first flap including a first engagement feature;

a second flap formed from a third piece of material, the second flap sewn to the base to extend therefrom and comprising a second inner surface and a second outer surface, the second flap including a second engagement feature;

a third flap formed from a fourth piece of material, the third flap sewn to the base to extend therefrom and comprising a third inner surface and a third outer surface, the third flap including a third engagement feature;

a securing element positioned on and extending from a first side of the base;

wherein:

at least three of the first, second, third, and fourth edges of the base are distal to the sewing positions of at least three of the first flap, second flap, third flap and securing element;

the second flap and the third flap each include a plurality of rectangular regions with each rectangular region joined to an adjacent rectangular region via a fold joint such that each rectangular region selectively pivots relative to an adjacent rectangular region at a fold joint;

when the apparatus is in an open condition in preparation for receiving the device, the first inner surface, the second inner surface, and the third inner surface can be caused to face in generally the same direction as faced by the generally planar region; and when the apparatus is in a closed condition about the device, the first inner surface, the second inner surface, and the third inner surface face generally towards the generally planar region with at least one of the second or third engagement features engaging the first engagement feature, and the first flap, the second flap, the third flap, and the base collectively define an enclosing volume sized to receive at least a portion of the device therein.

28. The apparatus of claim 27, wherein the first engagement feature includes at least a portion of a hook-and-loop arrangement.

29. The apparatus of claim 28, where the at least a portion of the hook-and-loop arrangement is positioned on the first outer surface of the first flap.

30. The apparatus of claim 29, wherein the at least a portion of the hook-and-loop arrangement extends over a substantial portion of the first outer surface.

31. The apparatus of claim 27, wherein the first flap is sewn to a portion of the base that is closer to the first edge than the second edge, the second flap is sewn to a portion of the base that is closer to the third edge than the fourth edge, and the third flap is sewn to a portion of the base that is closer to the fourth edge than the third edge.

32. A bag with a main compartment and a separate portable electronic device compartment with an adjustable containment apparatus for receiving a portable electronic device, the apparatus comprising:

a base formed from a first piece of material and constituting a portion of a panel of the portable electronic device compartment of the bag, the base comprising a generally planar region, a first edge, a second edge opposite the first edge, a third edge extending between the first edge and second edge, and a fourth edge opposite the third edge, the generally planar region bordered by the first, second, third and fourth edges;

a first flap formed from a second piece of material, the first flap sewn to the base to extend therefrom and comprising a first inner surface and a first outer surface, the first flap including a first engagement feature;

a second flap formed from a third piece of material, the second flap sewn to the base to extend therefrom and comprising a second inner surface and a second outer surface, the second flap including a second engagement feature;

a third flap formed from a fourth piece of material, the third flap sewn to the base to extend therefrom and comprising a third inner surface and a third outer surface, the third flap including a third engagement feature;

a securing element positioned on and extending from a first side of the base;

the second flap and the third flap each include a plurality of padded rectangular regions with each padded region joined to an adjacent padded region via a fold joint such that each rectangular region may be selectively pivoted relative to an adjacent rectangular region at a fold joint;

wherein:

at least three of the first, second, third, and fourth edges of the base are distal to the sewing positions of at least three of the first flap, second flap, third flap and securing element;

when the apparatus is in an open condition in preparation for receiving the device, the first inner surface, the second inner surface, and the third inner surface can be caused to face in generally the same direction as faced by the generally planar region; and when the apparatus is in a closed condition about the device, the first inner surface, the second inner surface, and the third inner surface face generally towards the generally planar region with at least one of the second or third engagement features engaging the first engagement feature, and the first flap, the second flap, the third flap, and the base collectively define an enclosing volume sized to receive at least a portion of the device therein.

33. The apparatus of claim 32, wherein the at least a portion of the hook-and-loop arrangement extends over a substantial portion of the first outer surface.

34. The apparatus of claim 32, wherein the first flap is sewn to a portion of the base that is closer to the first edge than the second edge, the second flap is sewn to a portion of the base that is closer to the third edge than the fourth edge, and the third flap is sewn to a portion of the base that is closer to the fourth edge than the third edge.

* * * * *